United States Patent [19]

Richardson

[11] 4,171,602

[45] Oct. 23, 1979

[54] SEMI-AUTOMATIC, POWER-DRIVEN, COLUMNIZED, FLAT-PLASTIC BAG CLOSURE APPLICATOR

[75] Inventor: James R. Richardson, Cowiche, Wash.

[73] Assignee: Kwik Lok Corporation, Yakima, Wash.

[21] Appl. No.: 869,849

[22] Filed: Jan. 16, 1978

[51] Int. Cl.[2] ..... B65B 51/04; B65B 57/02

[52] U.S. Cl. ..... 53/67; 53/138 A

[58] Field of Search ..... 53/138 A, 305, 390, 53/67, 417, 583

[56] References Cited

U.S. PATENT DOCUMENTS

| | | | |
|---|---|---|---|
| 2,705,100 | 3/1955 | Paxton et al. | 53/138 A |
| 3,061,983 | 11/1962 | Irwin | 53/138 A X |
| 3,163,972 | 1/1965 | Irwin | 53/138 A |
| 3,668,818 | 6/1972 | Holmes | 53/138 A X |

*Primary Examiner*—John Sipos

*Attorney, Agent, or Firm*—Dana E. Keech

[57] ABSTRACT

From the bottom of a vertical magazine, relatively large-sized stiffly flexible "Kwik Lok" bag closures (die stamped from 0.032" sheet polystyrene), and vertically stacked therein, compacted flatwise on each other, are individually power fed edge to edge sequentially along a rigid guide extending at a right angle forwardly from the bottom of the magazine and then dipping at its forward end to incline the front portion of the leading closure downward and thus facilitate manual insertion of a bunched polyethylene bag neck into a bag neck capturing aperture opening from the forward edge of the closure. The closures are fed one at a time from the magazine into the guide by a single revolution clutch which is triggered by each manual application to a bag neck of the forwardmost closure in the guide. This power cycle replaces the latter closure, as it is withdrawn from the machine with the bag, with another closure properly positioned in the guide to receive the neck of the next bag presented by the operator to the machine. Tardy manual removal of an endmost closure from the machine after applying it to a bag and coincidentally triggering the clutch, automatically aborts the clutch cycle (pending the final withdrawal of the bag captured closure) whereupon the aborted clutch cycle is automatically resumed, replacing the closure with another foremost closure, likewise downward dipped at its forward end.

1 Claim, 7 Drawing Figures

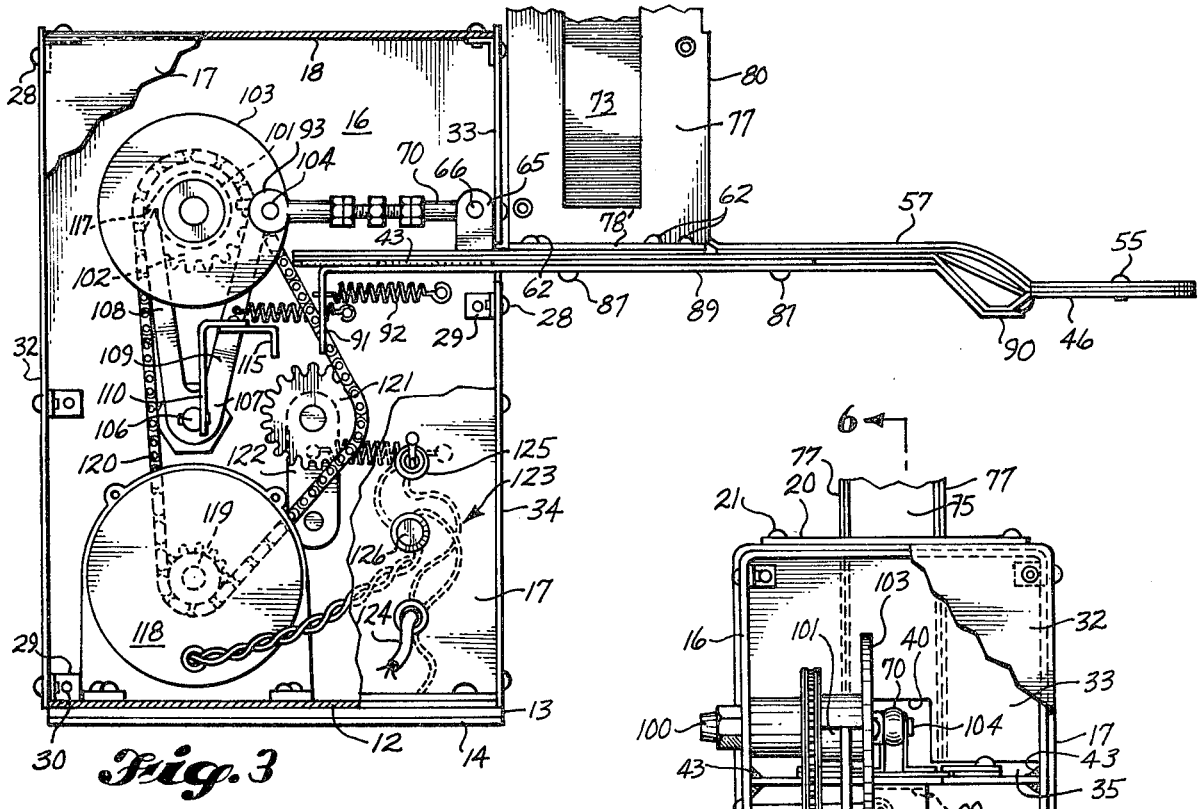
Fig. 3
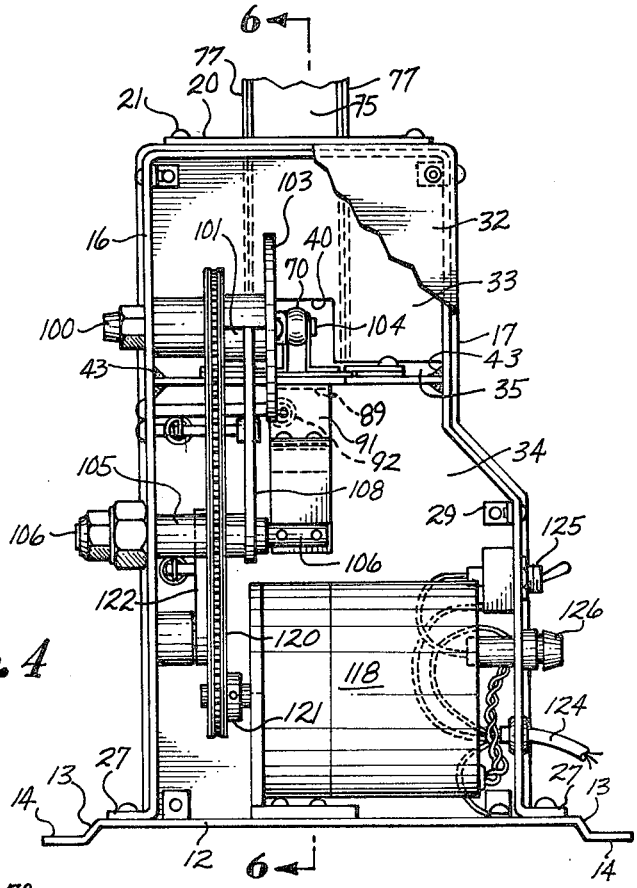
Fig. 4
Fig. 2
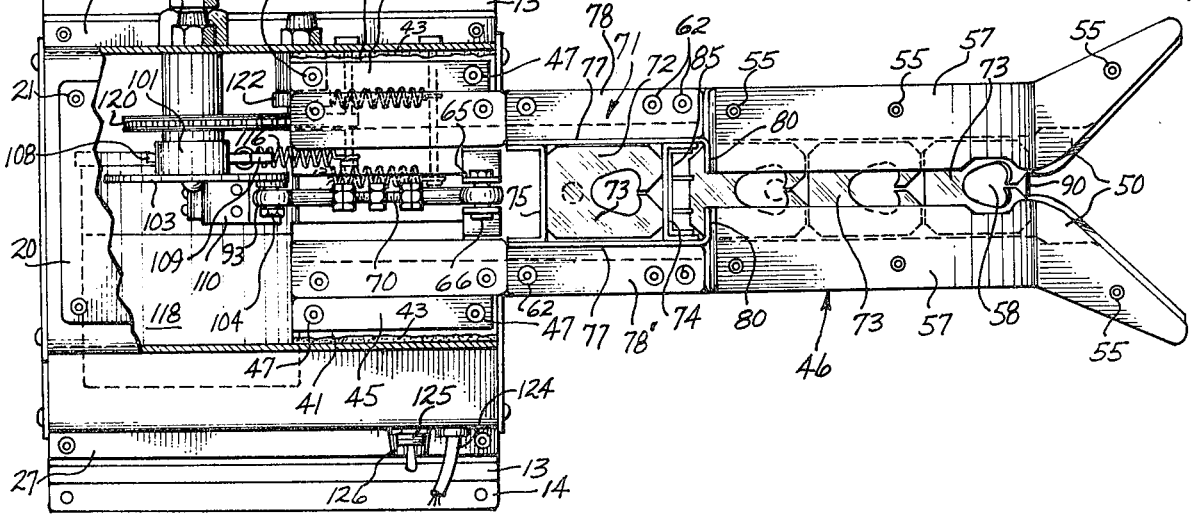

SEMI-AUTOMATIC, POWER-DRIVEN, COLUMNIZED, FLAT-PLASTIC BAG CLOSURE APPLICATOR

SUMMARY OF THE INVENTION

The nearest prior art reference is Irwin U.S. Pat. No. 3,061,983 which discloses an entirely hand power operated device for feeding "Kwik Lok" closures forwardly from the bottom end of a vertical magazine and deflecting the tip end of the foremost closure to facilitate the application to the latter of the vertically held bunched neck of a polystyrene bag moved horizontally towards said closure. The closure guide was slidably mounted on the bottom of the magazine and spring biased rearwardly. The closure pick was mounted on the back end of the closure guide and was actuated to feed a closure from the magazine into the guide by the operator pulling the guide to its forward limit in extracting from the front end of the guide the closure just applied to a bag.

Release of the closure guide from this endwise tension allows it to be spring returned to its rear limit position. Latch teeth (114) retain a sequence of two closures in the slide guide, the lead one of which is deflected downwardly in readiness to receive the next bag neck presented to the machine.

As a totally hand operated machine, the Irwin device is an excellent economical, small-capacity unit.

It is a particular object of the present invention to improve the Irwin applicator to substantially increase its capacity both as to the size and volume of closures it will handle with a relatively small increase in cost of manufacture and operating costs.

BRIEF DESCRIPTION OF THE DRAWINGS

FIG. 2 is a plan view of the invention with the main frame and access top cover partially broken away to reveal parts normally hidden by said frame and top.

FIG. 3 is a right side elevational view partly broken away to disclose details of the mechanism normally hidden by said main frame.

FIG. 4 is a back elevational view of the invention with portions of the rear end cover broken away to illustrate the mechanical details normally hidden by said cover.

DETAILED DESCRIPTION OF THE PREFERRED EMBODIMENT

Figure 1:
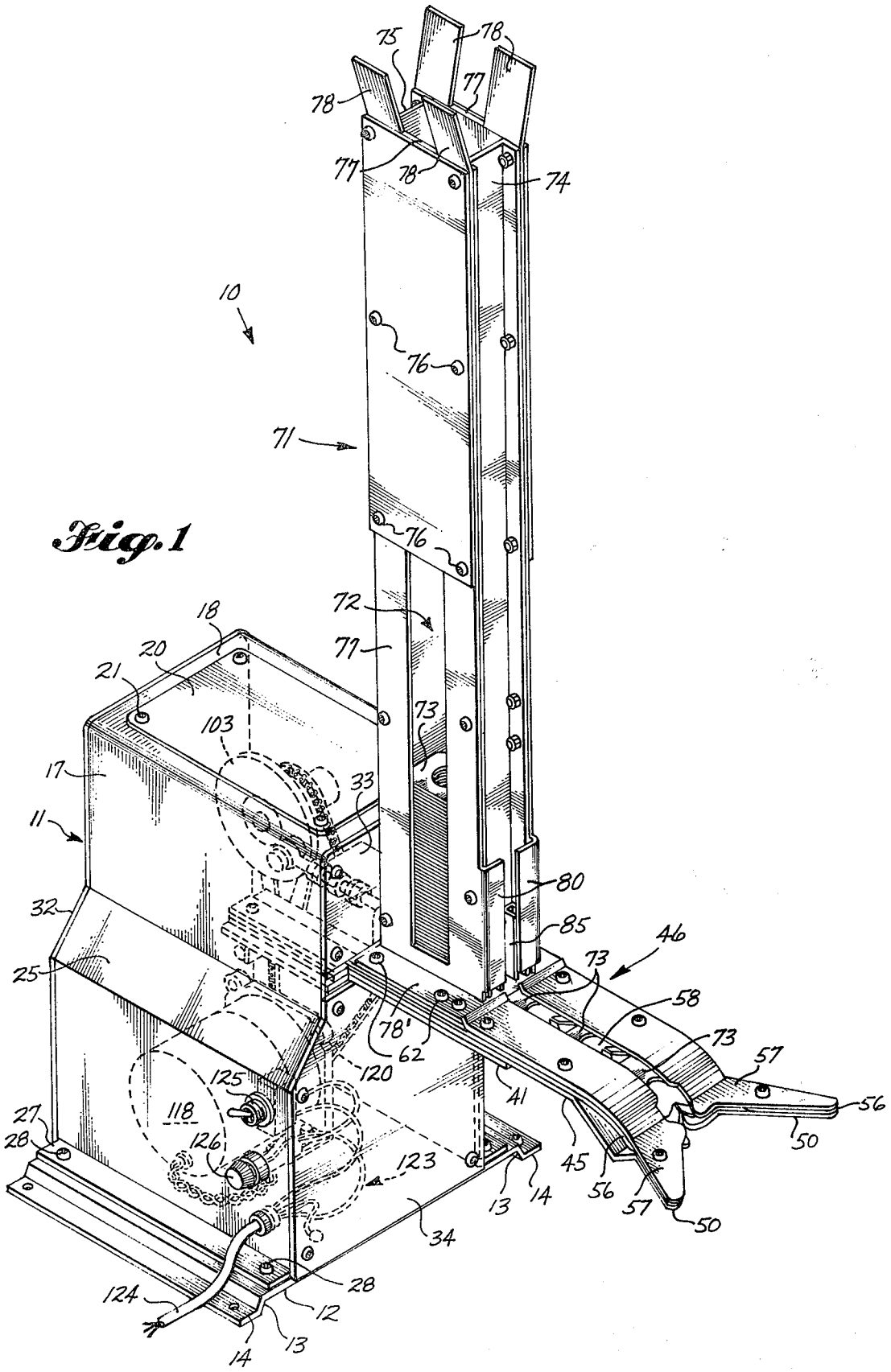
FIG. 1 is a perspective view of a preferred embodiment of the invention.
Figure 5:
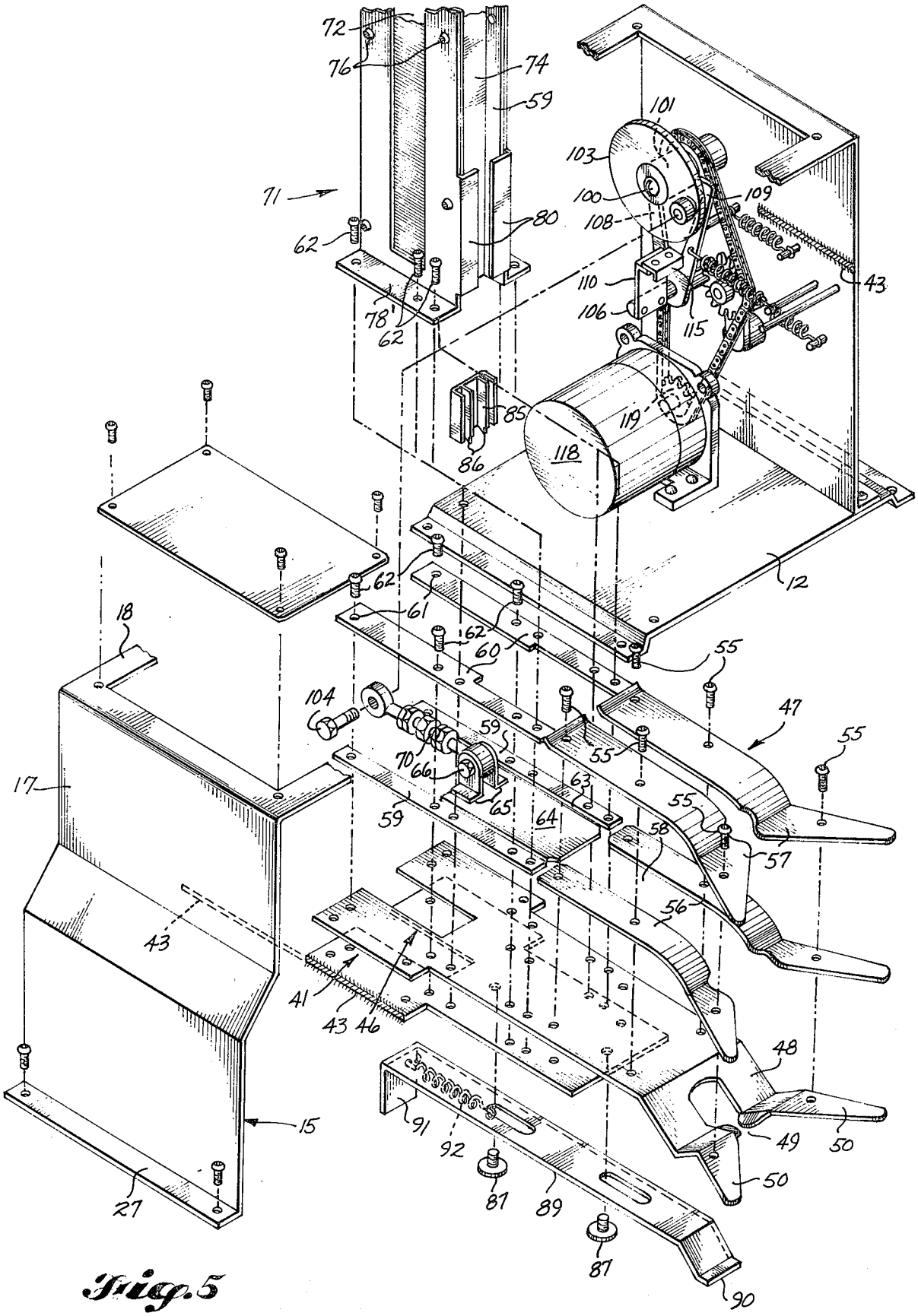
FIG. 5 is an exploded perspective view revealing the structure and details of the various parts of the invention and their relationship when assembled.

The illustrated preferred embodiment 10 of the present invention includes a box-like frame structure 11 which incorporates therein a rectangular bottom plate 12 opposite side edges of which have reverse bends 13 to form mounting flanges 14 which are apertured near their opposite ends to receive mounting bolts (not shown). The structure 11 also includes an inverted deep stamping 15 which provides left and right side plates 16 and 17 which are integrally united at their upper ends by top plate 18, the latter having an access hole 19 covered by a top cover 20, secured in place by screws 21.

The right side plate 17 has a double bend 25 formed therein approximately at its mid point to widen the lower half of frame structure 11 and the two side plates 16 and 17 are both provided at their lower edges with out-turned flanges 26 and 27 which rest against edge portions of bottom plate 12 and are secured thereto by screws 28. Angle brackets 29 are welded to inner faces of stamping 15 near its corners to provide tapped holes 30 for receiving screws 31 for securing to stamping 15 a rear cover 32 and upper and lower front covers 33 and 34. A gap 35 is provided between said upper and lower front covers which is enlarged centrally downwardly and upwardly at 40 for a purpose to be made clear hereinafter.

A principal function of frame structure 11 is to provide a rigid support for a platform plate 41 so that this will extend a substantial distance forwardly through gap 35. A rear portion 42 of platform 41 snugly fits between side plates 16 and 17 and is united to said plates by welds 43. A front portion 44 of platform 41 which is substantially narrower than rear portion 42 thereof, extends forwardly from frame structure 11 a distance equal to one and one-half times the width of said front portion.

Overlying and resting on platform plate 41 and secured rigidly thereto by four bolts 45 is the base plate 46 of a closure guide 47. This base plate is approximately co-extensive in outline with platform plate 41 excepting that it is narrow enough in its rear end portion to fit between welds 43 and extends forwardly through gap 35 a substantially greater distance than plate 41 and has formed on its front end a transverse dip 48, centrally axially apertured at 49, and terminates in a pair of symmetrically widely flaring horizontal bag neck guide jaws 50.

Overlying and flush with side edge portions of base plate 46 and secured thereto by screws 55 are closure guide side spacers 56 and side covers 57 which are shaped by die stamping to cooperate with base plate 46 to form a dipping channel 58 for slidably delivering a series of closures along said guide and deflecting the foremost closure downwardly to facilitate ready application of this closure to a vertically bunched bag neck pushed horizontally between jaws 50. Side edge portions of the balance of the base plate 46 are occupied by pick side guides 59 and pick confining covers 60 having aligned holes 61 for receiving screws 62 for fastening these elements to each other and to base plate 46 and platform 41. A slightly wider horizontal pick channel 63 is thus formed, in the same plane as and merging with closure channel 58, in which pick channel a closure pick 64 is slidably confined. Extending up from a rear edge portion of pick 64 are a pair of ears 65 having a horizontal pin 66 on which the front end of an extensibly adjustable pitman 70 is pivotally mounted.

Disposed just in front of the upper front cover 33 of frame 11 is a vertical magazine 71 having a rectangular tubular chamber 72 for slidably confining a column of individual "Kwik Lok" stiffly springy sheet polystyrene bag closures 73. This magazine includes front and rear sheet aluminum channels 74 and 75 which are secured by bolts 76 to left and right side walls 77, said side walls having outwardly inclined fingers 78 at their upper ends to aid in recharging said magazine, and lateral right angled bottom flanges 78' which are rigidly secured by certain of the screws 62 to the closure guide 47.

Co-planar, vertical, short, inwardly bent flanges 80 formed on front edges of side magazine walls 77 form a vertical pocket for slidably confining a closure gravity check trap 85 having a pair of forwardly downwardly inclined teeth 86 which obstruct any reverse travel of closures once delivered forwardly by pick 64 out of the magazine 71 into closure guide 47.

Extending through said downward enlargement in gap 35 in lower front cover 34 and slidably supported by two screws 87 screwed into tapped holes 88 provided in the bottom of platform plate 41, is a cold rolled clutch trigger actuating bar 89. These screws pass through axially aligned slots in said bar giving the latter a substantial degree of freedom for endwise movement. The front end 90 of said bar is bent downwardly and forwardly so as to terminate in alignment with the path taken by a bag neck being advanced for applying the endmost closure in said closure guide to said bag and said actuator bar 89 is thus automatically shifted rearwardly by the operators using the machine 10 to apply a closure 73 to a bag.

At its rear end, actuator bar 89 has a clutch actuator pusher plate 91 bent downward therefrom at a right angle and bar 89 is constantly biased forwardly by a spring 92 attached to said pusher plate.

The Continuously Power-Driven Single Revolution Clutch Mechanism

Mounted on left side plate 16 to extend cantilever fashion inwardly therefrom is a clutch mounting shaft 100 on which is freely rotatable a single revolution clutch 101 preferably a Warner Electric spring clutch of their PSI series.

Also mounted on shaft 100 and connected to the input end of said clutch is a fairly large diameter driven sprocket 102. Said shaft is preferably located on the same level as pick pitman rocker pin 66 and entirely on the left side of pin mounting ears 65. In fact, a pitman actuating disc 103 mounted on the inner end of shaft 100 and connected to the output end of said clutch must be on the left side of pitman 70 and close to the pitman so that a bearing 93 provided on the rear end of pitman 70 may connect with and pivot on a crank pin 104 provided on said disc.

Also mounted on left side plate 16 and extending cantileverwise inwardly therefrom underneath shaft 100 and in the same vertical plane therewith is a bearing 105 in which an idle shaft 106 journals. This shaft has fixed thereon a fork 107, the two tines of which comprise a clutch trigger 108 and a safety clutch opening arm 109, the purposes of which will be made clear hereinafter.

Fixed on and extending upwardly from the inner end of shaft 106 is clutch actuator blade 110 having a horizontally adjustable down bent tip portion 115 fixed thereon and extending forwardly therefrom in closely juxtaposed abutting relation with pusher plate 91 on the rear end of actuator bar 89. A coil spring 116 constantly spring biases the fork 107 and actuator blade 110 forward to bring the clutch trigger 108 normally pressed against the clutch 101 and in the path of a clutch controlling spring lip 117 whereby rotation of the clutch by the driven sprocket 102 is halted immediately upon the lip 117 engaging the tip of trigger 108, and starts again immediately upon shaft 106 being rotated counterclockwise by actuator bar 89 being pushed rearwardly against clutch actuator blade 110.

Mounted on bottom plate 12 is a normally constantly energized electric motor 118 having a drive sprocket 119 which is radially aligned with and connected by an endless chain 120 to driven sprocket 102. A spring biased idle sprocket 121 rockably mounted on an arm 122 pivoting on the inner face of frame side plate 16, keeps chain 120 taut.

The electrical circuit 123 serving the motor 118 includes a service cord 124, a switch 125 and a red on-off warning light 126.

OPERATION

The following steps are required to place the machine 10 in readiness to start using it commercially in applying closures 73 to the necks 130 of polyethylene plastic bags 131.

The magazine chamber 72 is filled with closures. The service cord 124 is plugged into a service outlet of any 115AC electric supply system and the switch 125 is turned on. Assuming the closure guide 47 is as yet empty, the operator presses rearwardly on the front end 90 of actuator bar 89 in rapid succession to accomplish three clutch cycles, each of which reciprocates closure pick 64 from its forwardmost position (FIGS. 1, 2 and 3) to its rearwardmost position (somewhere between FIGS. 6 and 7) and then returns it to its forwardmost position and stops.

Each of these three clutch cycles feeds a closure 73 from the bottom of the stack of closures occupying chamber 72 of magazine 71, into closure guide 47, thus filling the latter (with three closures) and propelling the foremost closure into the transversely dipped portion 48 of said guide so as to deflect said closure downwardly in readiness to be rapidly applied to the bunched neck 130 of a polyethylene bag 131.

The machine 10 is now prepared for regular commercial operation. To do this with maximum speed, filled bags with their necks pre-bunched are conveyor-fed to the operator of the machine and closed bags are conveyed away from the work station, by power or gravity.

The operator is trained to sieze and hand snug the bunched neck of each bag in its turn, shift the vertically held bunched neck horizontally between the guide jaws 50 to capture said neck within the forwardly presented aperture of the foremost closure 73 and to immediately withdraw the united bag neck and closure straight forward from the flaring front end of the closure guide channel in guide 47.

It is necessary that removal of the captured foremost closure 73 be normally accomplished rapidly because of the clutch 101 being tripped as soon as the rear movement of the bag neck into said closure is completed thereby initiating a rapid single revolution of the clutch during which another closure 73 will be delivered from the magazine into the closure guide 47, thus forcing an intermediate closure into the dipping channel 58 at the front end of said guide.

Figure 6:
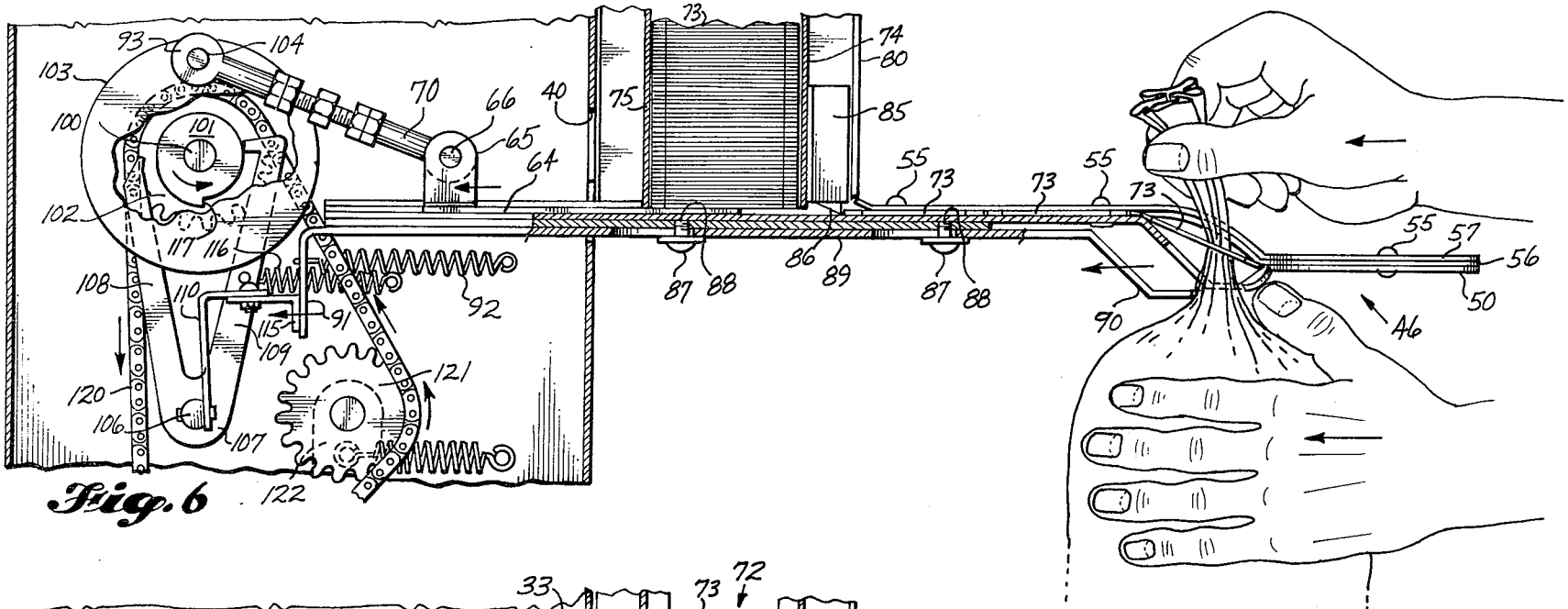
FIG. 6 is an enlarged vertical sectional detailed view taken on the line 6—6 of FIG. 4 and illustrating the parts of the machine just after the start of a cycle of applying the neck of a bag to a closure presented by the front end of the closure guide of the machine, this view showing said bag neck just after its having been inserted in the aperture of said closure and just before the operator withdraws said bag neck and closure forwardly from the machine.

The machine 10, however, is designed to absorb certain abuses occasionally met with when entrusted to unskilled labor for operation. One of these abuses results from unduly delaying the removal from the machine 10 of a bag just united with a foremost closure 73 lodged in the dipping channel 58 of guideway 47. As shown in FIG. 6, this causes the bag neck to continue pressing on the clutch trigger actuator bar 89 which holds the clutch control fork 108 rocked rearwardly. This causes the clutch safety arm 109 to intercept the clutch controlling spring lip 117 to tentatively abort the current closure feed cycle before starting its positive closure feeding phase. After this occurs the cycle remains aborted as long as the operator continues to press the bag into the closure in the machine. A reasonably quick withdrawal of the bag and the captured closure will release pressure on actuator bar 89 thus freeing clutch 101 to resume and complete the aborted closure feed cycle automatically, thereby replacing the closure just withdrawn from the front end of guideway 47 with the next closure therebehind.

Figure 7:
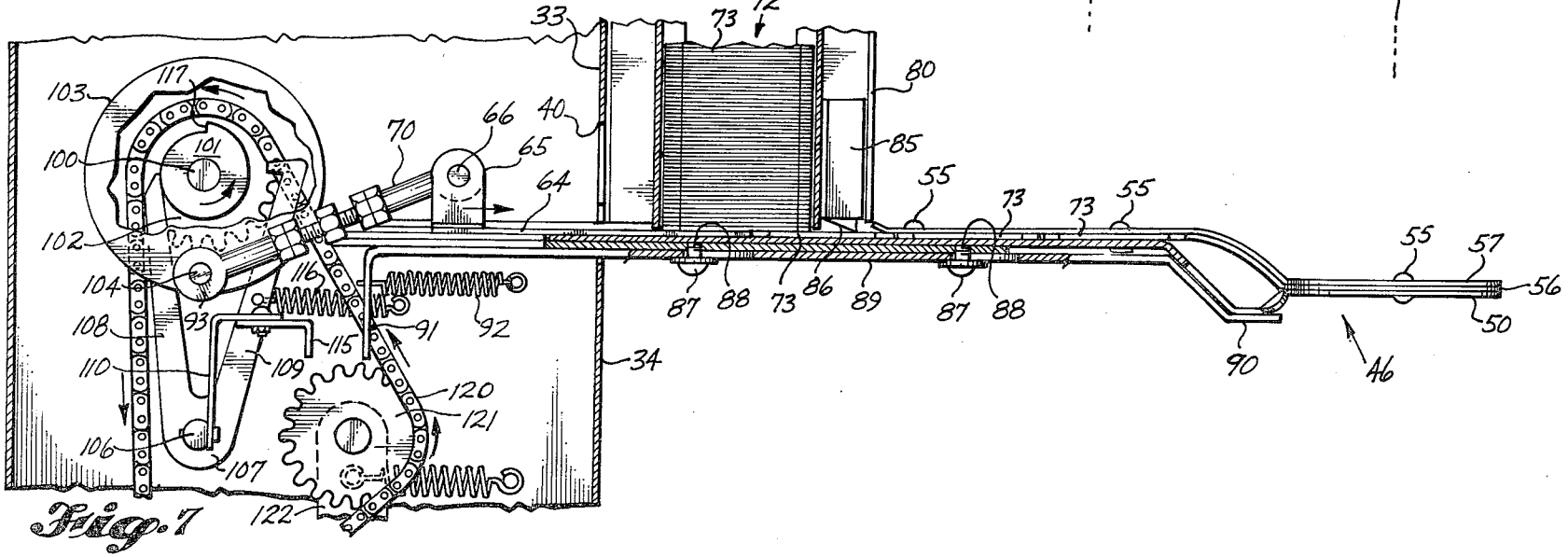
FIG. 7 is a view similar to FIG. 6 and illustrates the closure feeding cycle triggered by the bag closing cycle shown in FIG. 6 and just before said closure feeding cycle is concluded by feeding a closure forwardly from the bottom of the closure magazine so as to engage an intermediate closure left in the closure guide from the last previous operation of the machine so that the latter closure at the conclusion of the closure feeding cycle shown in FIG. 7, will occupy the downwardly inclined forward portion of said closure guide, which will be the position occupied by the foremost closure shown in FIG. 6 in the process of being united with a bunched bag neck.

Operators are trained, of course, to do their best to accomplish the application of the foremost closure in guideway 47 to the bunched neck of a bag and then withdraw the bag and captured closure from said guideway before the clutch spring clip reaches the clutch safety arm 109. Being thus released from pressure from bar 89, the fork 107 (including safety arm 109) is spring biased rightward as shown in FIG. 7 thereby allowing clutch lip 117 to continue past arm 109 in completing the single revolution closure feeding cycle started by the operator. Termination of said cycle takes place just as the pick plate 64 delivers a single closure 73 from the bottom of magazine 71 to the guideway 47, and at this moment, the rotation of clutch 101 is halted by the clutch lip 117 catching on the tip of clutch trigger 108, as shown in FIG. 3. This view also illustrates how the new closure 73 delivered into closure guide 47 propels the two previously fed intermediate closures 73 (shown in FIG. 2) the length of a single closure so as to advance the "next-to-be" foremost closure into the downward inclined closure dipping channel 58 so as to occupy said channel in readiness for the application of a bunched bag neck thereto.

While the machine is not harmed by the tentative aborting of a closure feed cycle, the operator soon learns to speed up the performance of his functions in running the machine 10 so that all closure feed cycles continue, once started, to completion.

This characteristic of machine 10 is thus seen to encourage competition between operators to maximize their packaging output using this invention.

I claim:

1. A semi-automatic, power driven dispenser of bag closures of flexible sheet material, each of which closures has an internal bag neck tripping aperture access to which may only be had between a pair of closely spaced jaws opening forwardly from the closure, said dispenser comprising:

a rectangular, closed, box-shaped housing means;

a narrow horizontal platform penetrating the front of said housing at a level located about two-thirds the way upward from the bottom of said housing and integrally welded internally to side walls of said housing to rigidly support said platform extending cantilever fashion a substantial distance from said housing, said platform penetrating said housing approximately one-half the length of the housing;

guide means rigidly fixed to said platform to overlie and reinforce the platform throughout its length, said guide means being laminated along its edges to form a pick plate guideway half of which is inside said housing and the other half is outside said housing, said guide means also forming a delivered-closure guideway extending from said pick plate guideway to the front end of said guide means;

a front end section of said guide means embodying means for flexing downwardly the forward aperture and jaw occupying portion of each of the closures delivered to said section and presenting said closure favorably for the introduction of a vertically held bunched bag neck horizontally between said jaws and into said aperture, said closure thereupon being captured by said bag and readily withdrawable with said bag from the machine;

a pick plate slideably mounted in said pick plate guideway and having transverse pivot means at the middle of its rear edge;

a vertical closure stack holding magazine secured to and supported by said guide means just outside of said housing means and overlying the external half of said pick guideway an delivering the lowermost closure in said stack by gravity constantly flatwise into said pick plate guideway and thus into the path of said pick plate during each power cycle;

continuously power-driven single revolution clutch means mounted within said housing and controlled by a spring biased rocker and having a pitman connected to said pivot means to accomplish a full reciprocation of said closure pick each time said clutch means is tripped;

trigger means spring biased forwardly into the path taken by each bag neck when it is being applied to the foremost closure in said guide means so as to automatically actuate said trigger means to cause it to trip said rocker and clutch means and produce a single revolution thereof, thereby delivering another closure from the bottom of said magazine along said closure guideway and propelling the next foremost closure into said front section of said guide means in readiness to be applied to the next bag neck presented manually to the machine; and said rocker having means for automatically engaging said clutch thereby aborting a clutch cycle prior to entering its closure feeding phase, in case of undue delay by the operator in manually withdrawing the currently foremost closure, said means accomplishing the resumption and completion of said clutch cycle as soon as the manual withdrawal of the bag captured currently foremost closure is completed.

* * * * *

UNITED STATES PATENT OFFICE
CERTIFICATE OF CORRECTION

Patent No. 4,171,602 Dated October 23, 1979

Inventor(s) James R. Richardson

It is certified that error appears in the above-identified patent and that said Letters Patent are hereby corrected as shown below:

Column 5, line 63, the word "tripping" should read --trapping--.

Column 6, line 35, the word "an" should read --and--.

Signed and Sealed this

*First* Day of *December 1981*

[SEAL]

*Attest:*

GERALD J. MOSSINGHOFF

*Attesting Officer*

*Commissioner of Patents and Trademarks*